US009218803B2

(12) United States Patent
Conkie et al.

(10) Patent No.: US 9,218,803 B2
(45) **Date of Patent: *Dec. 22, 2015**

(54) METHOD AND SYSTEM FOR ENHANCING A SPEECH DATABASE

(71) Applicant: AT&T Intellectual Property II, L.P., Atlanta, GA (US)

(72) Inventors: Alistair D. Conkie, San Jose, CA (US); Ann K. Syrdal, San Jose, CA (US)

(73) Assignee: AT&T Intellectual Property II, L.P., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/638,038

(22) Filed: Mar. 4, 2015

(65) Prior Publication Data

US 2015/0179162 A1 Jun. 25, 2015

Related U.S. Application Data

(63) Continuation of application No. 14/288,815, filed on May 28, 2014, now Pat. No. 8,977,552, which is a continuation of application No. 13/965,451, filed on Aug. 13, 2013, now Pat. No. 8,744,851, which is a continuation of application No. 11/469,134, filed on Aug. 31, 2006, now Pat. No. 8,510,113.

(51) Int. Cl.

| | |
|---|---|
| ***G10L 13/00*** | (2006.01) |
| ***G10L 21/00*** | (2013.01) |
| ***G10L 13/08*** | (2013.01) |
| ***G10L 13/06*** | (2013.01) |
| ***G10L 13/02*** | (2013.01) |

(52) U.S. Cl.

CPC ..... *G10L 13/02* (2013.01); *G10L 13/00* (2013.01); *G10L 13/06* (2013.01); *G10L 13/08* (2013.01)

(58) Field of Classification Search

USPC ..... 704/258, 260, 261, 267, 268, 266, 278, 704/270, 270.1, 275

See application file for complete search history.

(56) References Cited

U.S. PATENT DOCUMENTS

| | | | | |
|---|---|---|---|---|
| 5,412,712 | A | 5/1995 | Jennings | |
| 5,546,500 | A | 8/1996 | Lyberg | |
| 5,636,325 | A | 6/1997 | Farrett | |
| 5,835,912 | A | 11/1998 | Pet | |
| 5,865,626 | A | 2/1999 | Beattie et al. | |
| 6,061,646 | A * | 5/2000 | Martino et al. | 704/3 |
| 6,141,642 | A | 10/2000 | Oh | |
| 6,173,263 | B1 | 1/2001 | Conkie | |

(Continued)

OTHER PUBLICATIONS

Silke Goronzy, Kathrin Eisele, "Automatic Pronunciation Modelling for Multiple Non-Native Accents" Proc. of ASRU 03, pp. 123-128, 2003.

(Continued)

*Primary Examiner* — Edgar Guerra-Erazo

(57) ABSTRACT

A system, method and computer readable medium that enhances a speech database for speech synthesis is disclosed. The method may include labeling audio files in a primary speech database, identifying segments in the labeled audio files that have varying pronunciations based on language differences, identifying replacement segments in a secondary speech database, enhancing the primary speech database by substituting the identified secondary speech database segments for the corresponding identified segments in the primary speech database, and storing the enhanced primary speech database for use in speech synthesis.

20 Claims, 6 Drawing Sheets

(56) References Cited

U.S. PATENT DOCUMENTS

| | | | | |
|---|---|---|---|---|
| 6,188,984 | B1 | 2/2001 | Manwaring et al. | |
| 6,343,270 | B1 | 1/2002 | Bahl et al. | |
| 6,778,962 | B1 | 8/2004 | Kasai et al. | |
| 6,865,535 | B2 | 3/2005 | Yamada et al. | |
| 6,950,798 | B1 | 9/2005 | Beutnagel et al. | |
| 6,975,987 | B1 | 12/2005 | Tenpaku et al. | |
| 7,043,431 | B2 | 5/2006 | Riis et al. | |
| 7,047,194 | B1 | 5/2006 | Buskies | |
| 7,113,909 | B2 | 9/2006 | Nukaga et al. | |
| 7,120,581 | B2 * | 10/2006 | Kahn et al. | 704/235 |
| 7,155,391 | B2 | 12/2006 | Taylor | |
| 7,319,958 | B2 | 1/2008 | Melnar et al. | |
| 7,383,182 | B2 | 6/2008 | Taylor | |
| 7,472,061 | B1 | 12/2008 | Alewine et al. | |
| 7,496,498 | B2 | 2/2009 | Chu et al. | |
| 7,567,896 | B2 | 7/2009 | Coorman et al. | |
| 7,725,309 | B2 | 5/2010 | Bedworth | |
| 7,912,718 | B1 | 3/2011 | Conkie et al. | |
| 2001/0056348 | A1 | 12/2001 | Hyde-Thomson et al. | |
| 2003/0171910 | A1 | 9/2003 | Abir | |
| 2003/0195743 | A1 | 10/2003 | Kuo et al. | |
| 2003/0208355 | A1 | 11/2003 | Stylianou et al. | |
| 2004/0039570 | A1 | 2/2004 | Harengel et al. | |
| 2004/0111271 | A1 | 6/2004 | Tischer | |
| 2004/0128143 | A1 * | 7/2004 | Kahn et al. | 704/277 |
| 2004/0172257 | A1 * | 9/2004 | Liqin et al. | 704/277 |
| 2004/0193398 | A1 | 9/2004 | Chu et al. | |
| 2005/0060151 | A1 | 3/2005 | Kuo et al. | |
| 2005/0071163 | A1 | 3/2005 | Aaron et al. | |
| 2005/0144003 | A1 | 6/2005 | Iso-Sipila | |
| 2005/0182629 | A1 | 8/2005 | Coorman et al. | |
| 2005/0182630 | A1 | 8/2005 | Miro et al. | |
| 2005/0273337 | A1 | 12/2005 | Erell et al. | |
| 2006/0069567 | A1 | 3/2006 | Tischer et al. | |
| 2007/0112554 | A1 | 5/2007 | Goradia | |
| 2007/0118377 | A1 | 5/2007 | Badino et al. | |
| 2007/0203703 | A1 | 8/2007 | Yoshida | |
| 2007/0219777 | A1 * | 9/2007 | Chu et al. | 704/9 |
| 2007/0225967 | A1 | 9/2007 | Childress et al. | |
| 2007/0271086 | A1 | 11/2007 | Peters et al. | |
| 2010/0082329 | A1 | 4/2010 | Silverman et al. | |
| 2011/0238407 | A1 | 9/2011 | Kent | |

OTHER PUBLICATIONS

Badino et al., "Approach to TTS Reading of Mixed-Language Texts", Proc. of 5th ISCA Tutorial and Research Workshop on Speech Synthesis, Pittsburg, PA 2004.

Campbell, Nick, "Foreign-Language Speech Synthesis", Proc ESCA/COCOSDA ETRW on Speech Synthesis, Jenolon Caves, Australia, 1998.

Stylianou et al., (1997) "Diphone concatenation using a Harmonic plus Noise Model of Speech," IN: Eurospeech '97, pp. 613-616.

Lehana, P.K., Pandey, P.C., 2003, Improving quality of speech synthesis in Indian Languages, in WSLP-2003, pp. 149-155.

Arranz et al., "The FAME Speech-to-Speech Translation System for Catalan, English and Spanish", Proceedings of the 10th Machine Translation Summit, pp. 195-202, 2005.

Ellen M. Eide et al., "Towards Pooled-Speaker Concatenative Text-to-Speech", ICASSP 2006, IEEE, pp. I-73-I-76.

Susan R. Hertz, "Intergration of Rule-Based Formant Synthesis an Wave from Concatenation: A Hybrid Approach to Text-to-Speech Synthesis", Published in Proceedings IEEE 2002 Workshop on Speech Synthesis, Santa Monica, CA 5 pages.

Walker, B.D., et al., 2003, "Language reconfigurable universal phone recognition", In EUROSPEECH-2003, 153-156.

Lehana P.K. et al., "Speech syntesis in Indian languages", Proc. Int. Conf. on Universal Knowledge and Languages-2002, Goa, India, Nov. 25-29, 2002, paper No. pk1510.

A. Conkie, 1999, "A robust unit selection system for speech synthesis", Proc. 137th meet. ASA/Forum Acusticum, Berlin, Mar. 1999.

Beutnagel, Mark et al., 1998, "Diphone Synthesis Using Unit Selection", In SSW3-1998, 185-190.

I. Esquerra et al., "A bilingual Spanish-Catalan Database of Units for Concatenative Synthesis", Workshop on Language Resources for European Minority Languges, Granada 1998.

* cited by examiner

METHOD AND SYSTEM FOR ENHANCING A SPEECH DATABASE

PRIORITY INFORMATION

The present application is a continuation of U.S. patent application Ser. No. 14/288,815, filed May 28, 2014, which is a continuation of U.S. patent application Ser. No. 13/965,451, filed Aug. 13, 2013, now U.S. Pat. No. 8,744,851, issued Jun. 3, 2014, which is a continuation of U.S. patent application Ser. No. 11/469,134, filed Aug. 31, 2006, now U.S. Pat. No. 8,510,113, issued Aug. 13, 2013, the content of which are incorporated herein by reference in their entirety.

BACKGROUND OF THE INVENTION

1. Field of the Invention

The present invention relates to a feature for enhancing the speech database for use in a text-to-speech system.

2. Introduction

Recently, unit selection concatenative synthesis has become the most popular method of performing speech synthesis. Unit Selection differs from older types of synthesis by generally sounding more natural and spontaneous than formant synthesis or diphone-based concatenative synthesis. Unit selection synthesis typically scores higher than other methods in listener ratings of quality. Building a unit selection synthetic voice typically involves recording many hours of speech by a single speaker. Frequently the speaking style is constrained to be somewhat neutral, so that the synthesized voice can be used for general-purpose applications.

Despite its popularity, unit selection synthesis has a number of limitations. One is that once a voice is recorded, the variations of the voice are limited to the variations within the database. While it may be possible to make further recordings of a speaker, this process may not be practical and is also very expensive.

SUMMARY OF THE INVENTION

A system, method and computer readable medium that enhances a speech database for speech synthesis is disclosed. The method may include labeling audio files in a primary speech database, identifying segments in the labeled audio files that have varying pronunciations based on language differences, identifying replacement segments in a secondary speech database, enhancing the speech database by substituting the identified secondary speech database segments for the corresponding identified segments in the primary speech database, and storing the enhanced speech database for use in speech synthesis.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
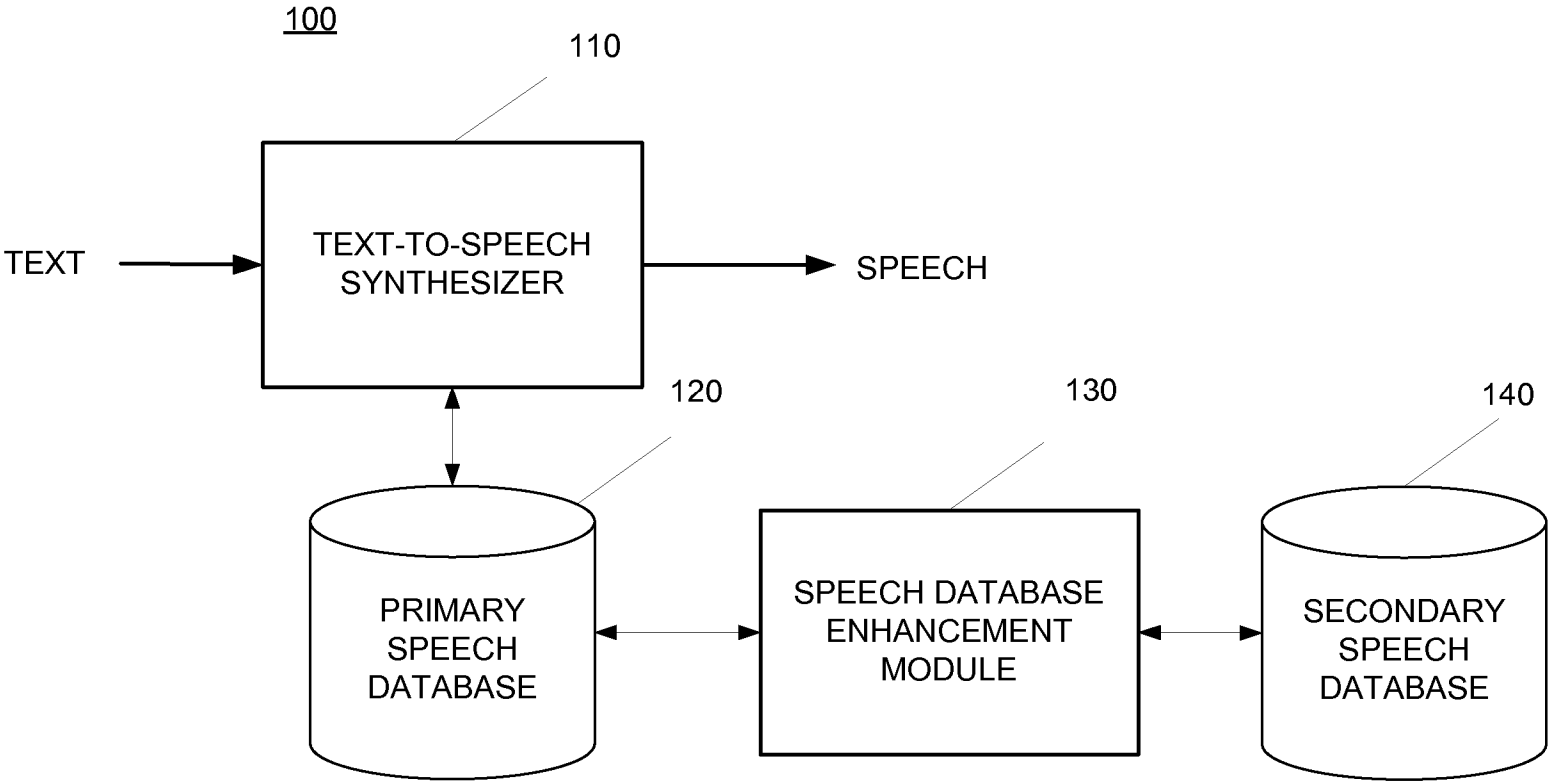
FIG. 1 illustrates an exemplary diagram of a speech synthesis system in accordance with a possible embodiment of the invention.

Additional features and advantages of the invention will be set forth in the description which follows, and in part will be obvious from the description, or may be learned by practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth herein.

Various embodiments of the invention are discussed in detail below. While specific implementations are discussed, it should be understood that this is done for illustration purposes only. A person skilled in the relevant art will recognize that other components and configurations may be used without parting from the spirit and scope of the invention.

The present invention comprises a variety of embodiments, such as a system, method, computer-readable medium, and other embodiments that relate to the basic concepts of the invention.

This invention concerns synthetic voices using unit selection concatenative synthesis where portions of the database audio recordings are modified for the purpose of producing a wider set of speech segments (e.g., syllables, phones, half-phones, diphones, triphones, phonemes, half-phonemes, demi-syllables, polyphones, etc.) than is contained in the original database of voice recordings. Since it is known that performing global signal modification for the purposes of speech synthesis significantly reduces perceived voice quality, the modifications that performed as described herein may be aperiodic portions of the signal that tend neither to cause concatenation discontinuities nor to convey much of the individual character or affect of the speaker. However, while it is generally easier to substitute aperiodic components than periodic components, periodic components can be substituted in accordance with the invention. While difficulty increases with increasing energy in the sound (such as with vowels), it is still possible to use the techniques described herein to substitute for almost all sounds, especially nasals, stops, fricatives, for example. In addition, if the two speakers have similar characteristics, then vowel substitution could also be more easily performed.

The speech database enhancement module 130 is potentially useful for applications where a voice may need to be extended in some way, for example to pronounce foreign words. As a specific example, the word "Bush" in Spanish would be strictly pronounced /b/ /u/ /s/ (SAMPA), since there is no /S/ in Spanish. However, in the U.S., "Bush" is often rendered by Spanish speakers as /b/ /u/ /S/. These loan phonemes typically are produced and understood by Spanish speakers, but are not used except in loan words.

There are languages, such as German and Spanish, where English, French, or Italian loan words are often used. There are also regions where there is a large population living in a linguistically distinct environment and frequently using and adapting foreign names. The desire would be to have the ability to synthesize such material accurately without having to resort to adding special recordings. Another problem may arise if the speaker is unable to pronounce the required "foreign" phones acceptably, thus rendering additional recordings impossible.

There are also instances in which the phonetic inventories differ between two dialects or regional accents of a language. In this case, expansion of the phonetic coverage of a synthetic voice created to speak one dialect to cover the other dialect is needed as well.

Thus, enhancing an existing database through phonetic expansion is a method to address the above issues. As an example, Spanish is used, and specifically on the phenomenon of "seseo," one of the principal differences between European and Latin American Spanish. Seseo refers to the choice between /T/ or /s/ in the pronunciation of words. There is a general rule that in Peninsular (European) Spanish the orthographic symbols z and c (the latter followed by i or e) are pronounced as /T/. In Latin American varieties of Spanish these graphemes are always pronounced as /s/. Thus, for the word "gracias" (or "thanks") the transcription would be /gra-Tias/ in Peninsular Spanish or /grasias/ in Latin American Spanish. Seseo is one major distinction (but certainly not the only distinction) between Old and New World dialects of Spanish Three methods are discussed in detail below to extend the phonetic coverage of unit selection speech: (1) by modifying parts of a speech database so that extra phones extracted from a secondary speech database can be added off line; (2) by extending the above methodology by using a speech representation model (e.g., harmonic plus noise model (HNM), etc.) in order to modify speech segments in the speech database; and (3) by combining recorded inventories from two speech databases so that at synthesis time selections can be made from either. While three methods are shown as examples, the invention may encompass modifications to the processes as described as well other methods that perform the function of enhancing a speech database.

FIG. 1 illustrates an exemplary diagram of a speech synthesis system 100 in accordance with a possible embodiment of the invention. In particular, the speech synthesis system 100 includes text-to-speech synthesizer 110, primary speech database 120, speech database enhancement module 130 and secondary speech database 140. The speech synthesizer 110 represents any speech synthesizer known to one of skilled in the art which can perform the functions of the invention disclosed herein or the equivalence thereof. In its simplest form, the speech synthesizer 110 takes text input from a user in one or more of several forms, including keyboard entry, scanned in text, or audio, such as a foreign language which has been processed through a translation module, etc. The speech synthesizer 110 then converts the input text to a speech output using inputs from the primary speech database 120 which is enhanced by the speech database enhancement module 130, as set forth in detail below.

Figure 2:
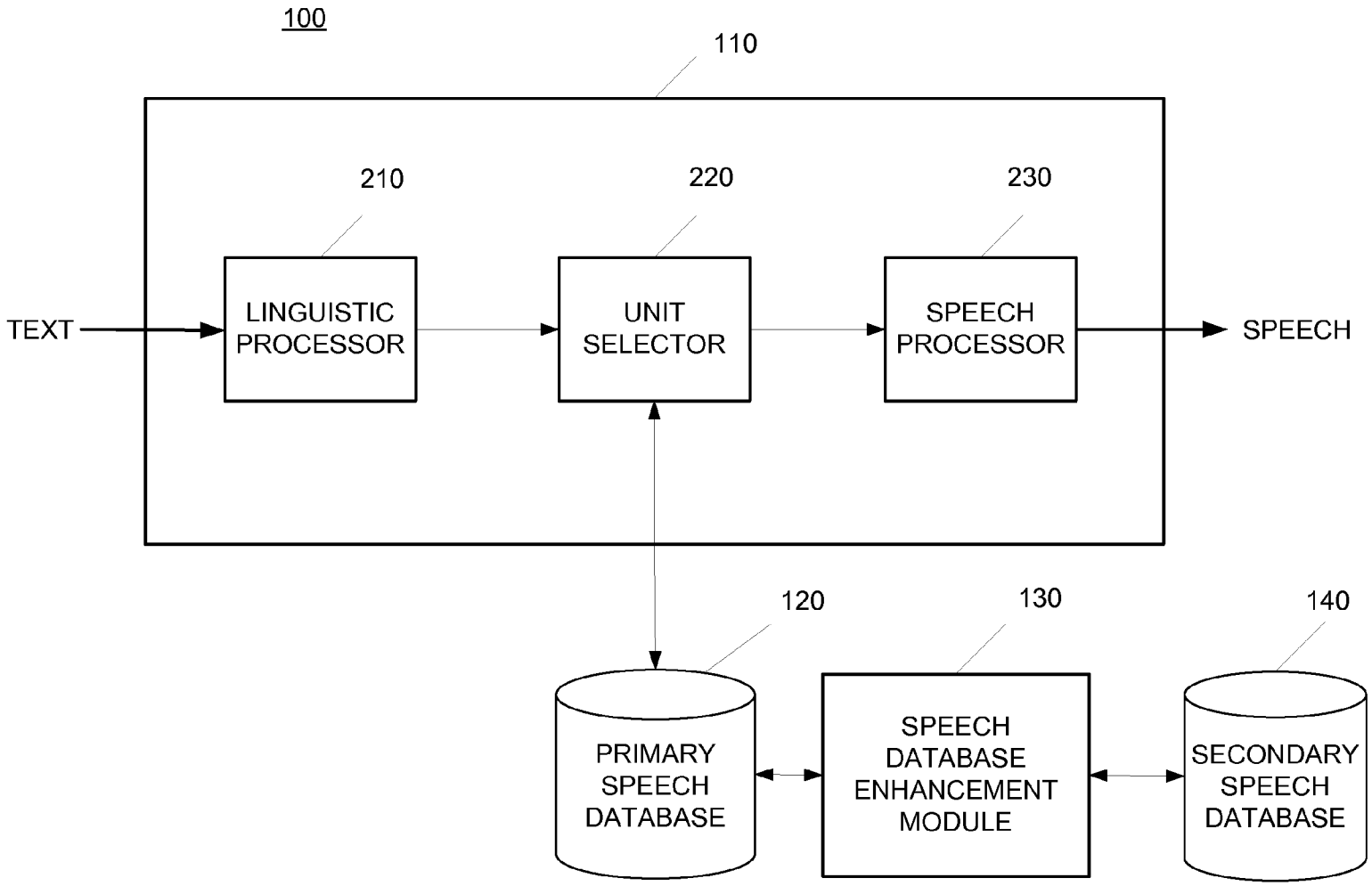
FIG. 2 illustrates an exemplary block diagram of an exemplary speech synthesis system utilizing the speech database enhancement module in accordance with a possible embodiment of the invention.

FIG. 2 shows a more detailed exemplary block diagram of the text-to-speech synthesis system 100 of FIG. 1. The speech synthesizer 110 includes linguistic processor 210, unit selector 220 and speech processor 230. The unit selector 220 is connected to the primary speech database 120. As stated in FIG. 1, the text-to-speech synthesis system 100 also includes the speech database enhancement module 130 and secondary speech database 140. The primary speech database 120 may be any memory device internal or external to the speech synthesizer 110 and the speech database enhancement module 130. The primary speech database 120 may contain raw speech in digital format, an index which lists speech segments (syllables, phones, half-phones, diphones, triphones, phonemes, half-phonemes, demi-syllables, polyphones, etc.) in ASCII, for example, along with their associated start times and end times as reference information, and derived linguistic information, such as stress, accent, parts-of-speech (POS), etc.

Text is input to the linguistic processor 210 where the input text is normalized, syntactically parsed, mapped into an appropriate string of speech segments, for example, and assigned a duration and intonation pattern. A string of speech segments, such as syllables, phones, half-phones, diphones, triphones, phonemes, half-phonemes, demi-syllables, polyphones, etc., for example, is then sent to unit selector 220. The unit selector 220 selects candidates for requested speech segment sequence with speech segments from the primary speech database 120. The unit selector 220 then outputs the "best" candidate sequence to the speech processor 230. The speech processor 230 processes the candidate sequence into synthesized speech and outputs the speech to the user.

Figure 3:
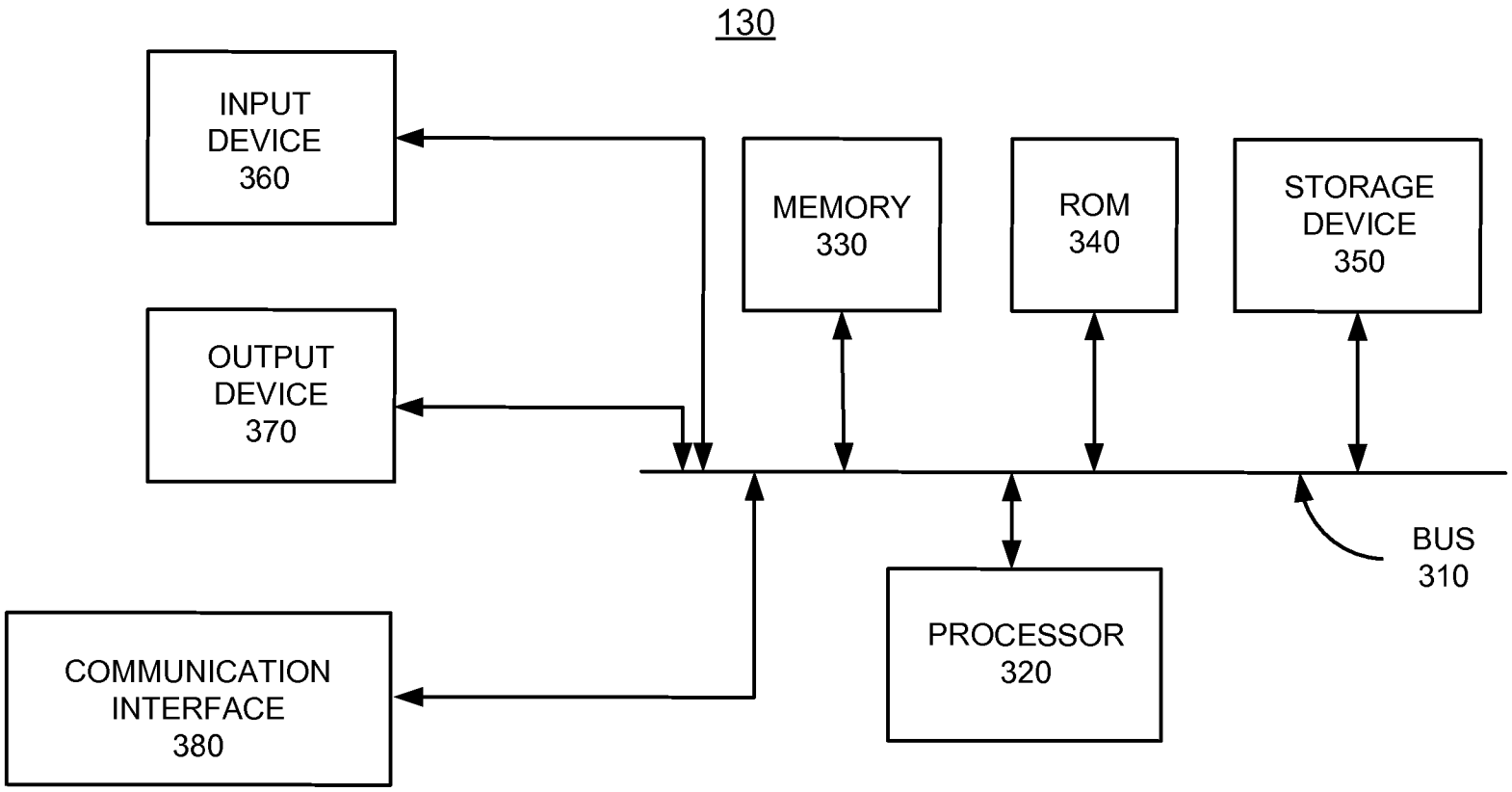
FIG. 3 illustrates an exemplary block diagram of a processing device for implementing the speech database enhancement method in accordance with a possible embodiment of the invention.

FIG. 3 illustrates an exemplary speech database enhancement module 130 which may implement one or more modules or functions shown in FIGS. 1-4. Thus, exemplary speech database enhancement module 130 may include may include a bus 310, a processor 320, a memory 330, a read only memory (ROM) 340, a storage device 350, an input device 360, an output device 370, and a communication interface 380. Bus 310 may permit communication among the components of the speech database enhancement module 130.

Processor 320 may include at least one conventional processor or microprocessor that interprets and executes instructions. Memory 330 may be a random access memory (RAM) or another type of dynamic storage device that stores information and instructions for execution by processor 320. Memory 330 may also store temporary variables or other intermediate information used during execution of instructions by processor 320. ROM 340 may include a conventional ROM device or another type of static storage device that stores static information and instructions for processor 320. Storage device 350 may include any type of media, such as, for example, magnetic or optical recording media and its corresponding drive.

Input device 360 may include one or more conventional mechanisms that permit a user to input information to the speech database enhancement module 130, such as a keyboard, a mouse, a pen, a voice recognition device, etc. Output device 370 may include one or more conventional mechanisms that output information to the user, including a display, a printer, one or more speakers, or a medium, such as a memory, or a magnetic or optical disk and a corresponding disk drive. Communication interface 380 may include any transceiver-like mechanism that enables the speech database enhancement module 130 to communicate via a network. For example, communication interface 380 may include a modem, or an Ethernet interface for communicating via a local area network (LAN). Alternatively, communication interface 380 may include other mechanisms for communicating with other devices and/or systems via wired, wireless or optical connections. In some implementations of the network environment 100, communication interface 380 may not be included in exemplary speech database enhancement module 130 when the speech database enhancement process is implemented completely within a single speech database enhancement module 130.

The speech database enhancement module 130 may perform such functions in response to processor 320 by executing sequences of instructions contained in a computer-readable medium, such as, for example, memory 330, a magnetic disk, or an optical disk. Such instructions may be read into memory 330 from another computer-readable medium, such as storage device 350, or from a separate device via communication interface 380.

The speech synthesis system 100 and the speech database enhancement module 130 illustrated in FIG. 1 and the related discussion are intended to provide a brief, general description of a suitable computing environment in which the invention may be implemented. Although not required, the invention will be described, at least in part, in the general context of computer-executable instructions, such as program modules, being executed by the speech database enhancement module 130, such as a general purpose computer. Generally, program modules include routine programs, objects, components, data structures, etc. that perform particular tasks or implement particular abstract data types. Moreover, those skilled in the art will appreciate that other embodiments of the invention may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

For illustrative purposes, the speech database enhancement process will be described below in relation to the block diagrams shown in FIGS. 1, 2 and 3.

Figure 4:
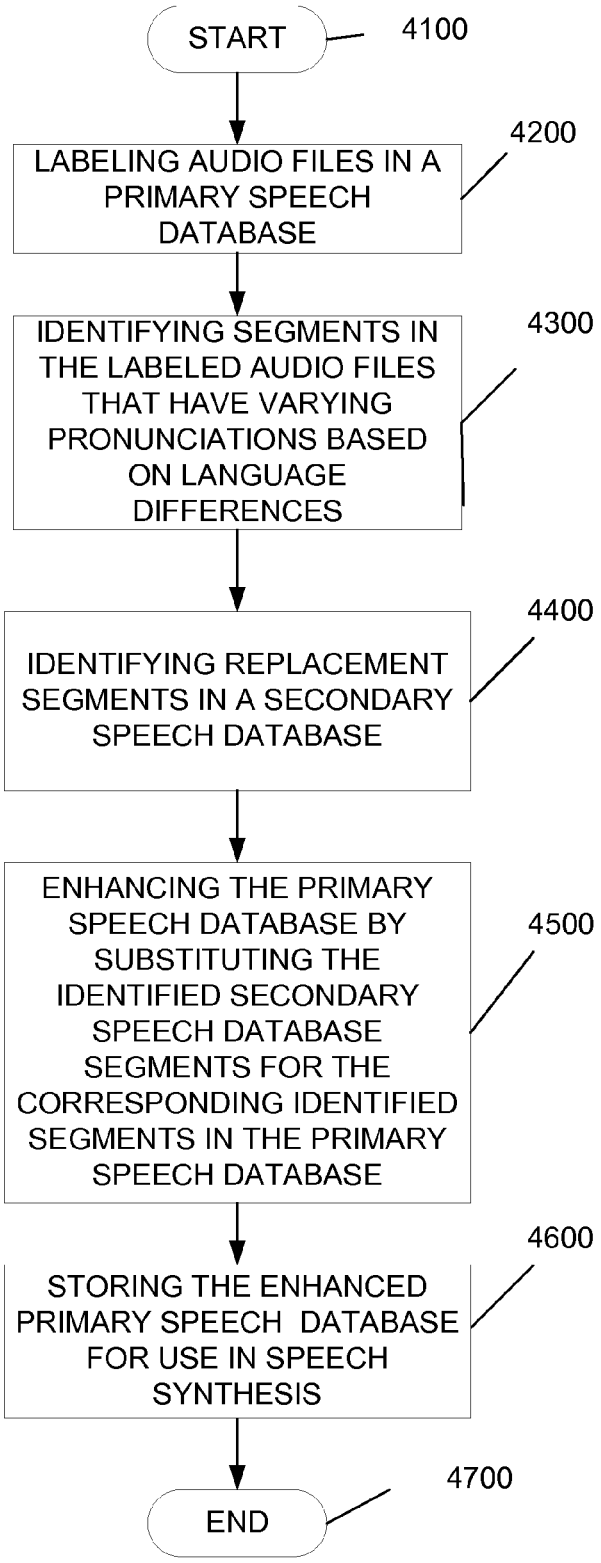
FIG. 4 illustrates an exemplary flowchart illustrating one possible speech database enhancement method in accordance with one possible embodiment of the invention.

FIG. 4 is an exemplary flowchart illustrating some of the basic steps associated with a speech database enhancement process in accordance with a possible embodiment of the invention. In this process, waveform segments in the primary speech database 120 are directly substituted by others from the secondary speech database 140. This segment substitution process may be performed offline. The process begins at step 4100 and continues to step 4200 where the speech database enhancement module 130 labels audio files in the primary speech database 120. At step 4300, the speech database enhancement module 130 identifies segments in the labeled audio files that have varying pronunciations based on language differences. Language differences may be a separate language, for example, such as English and Spanish, the result of dialect, geographic, or regional differences, such as Latin American Spanish and European Spanish, accent differences, national language differences, idiosyncratic speech differences, database coverage differences, etc. Database coverage differences may result from a lack or sparsity of certain speech units in a database. Idiosyncratic speech differences may concern the ability to imitate the voice of another individual.

Identification of segments to be replaced may be performed by locating obstruents and nasals, for example. The obstruents covers stops (b,d,g,p,t,k), affricates covers (ch,j), and fricatives covers (f,v,th,dh,s,z,sh,zh)., for example At step 4400, the speech database enhancement module 130 identifies replacement segments in the secondary speech database 140. At step 4500, the speech database enhancement module 130 enhances the primary speech database 120 by substituting the identified secondary speech database 140 segments for the corresponding identified segments in the primary speech database 120. At step 4600, the speech database enhancement module 130 stores the enhanced primary speech database 120 for use in speech synthesis. The process goes to step 4700 and ends.

As an illustrative example of the FIG. 4 process, the speech database enhancement module 130 may identify segments in the primary speech database 120 that could be substituted by a different fricative. For example, the speech database enhancement module 130 may identify the /s/ fricatives in the primary speech database 120 that in Peninsular Spanish would be pronounced as /T/. Because the unit boundaries in a unit selection database such as the primary speech database 120 are not always, or even necessarily, on phone boundaries, and the process may mark the precise boundaries of the fricatives or other language units of interest, independent of any labeling that exists in the primary speech database 120 for the purposes of unit selection synthesis.

Again, using fricatives as an example, the speech database enhancement module 130 can readily identify the /s/ in the primary speech database 120 and /T/ in the secondary speech database 140 in a majority of cases by relatively abrupt C-V (unvoiced-voiced) or V-C (voiced-unvoiced) transitions. The speech database enhancement module 130 may locate the relevant phone boundaries using a variant of the zero-crossing calculation or some other method known to one of skill in the art, for example. The speech database enhancement module 130 may treat other automatically-marked boundaries with more suspicion. In any event, the goal is for the speech database enhancement module 130 to establish reliable phone boundaries, both in the primary speech database 120 and in the secondary speech database 140.

Once identified, the speech database enhancement module 130 may splice the new /T/ audio waveforms from the secondary speech database 140 into the primary speech database 120 in place of the original /s/ audio, with a smooth transition. With the new audio files and associated speech segment (e.g., syllables, phones, half-phones, diphones, triphones, phonemes, half-phonemes, demi-syllables, polyphones, etc.) labels, a complete voice was built in the normal fashion in the primary speech database 120 which may be stored and used for unit selection speech synthesis.

Figure 5:
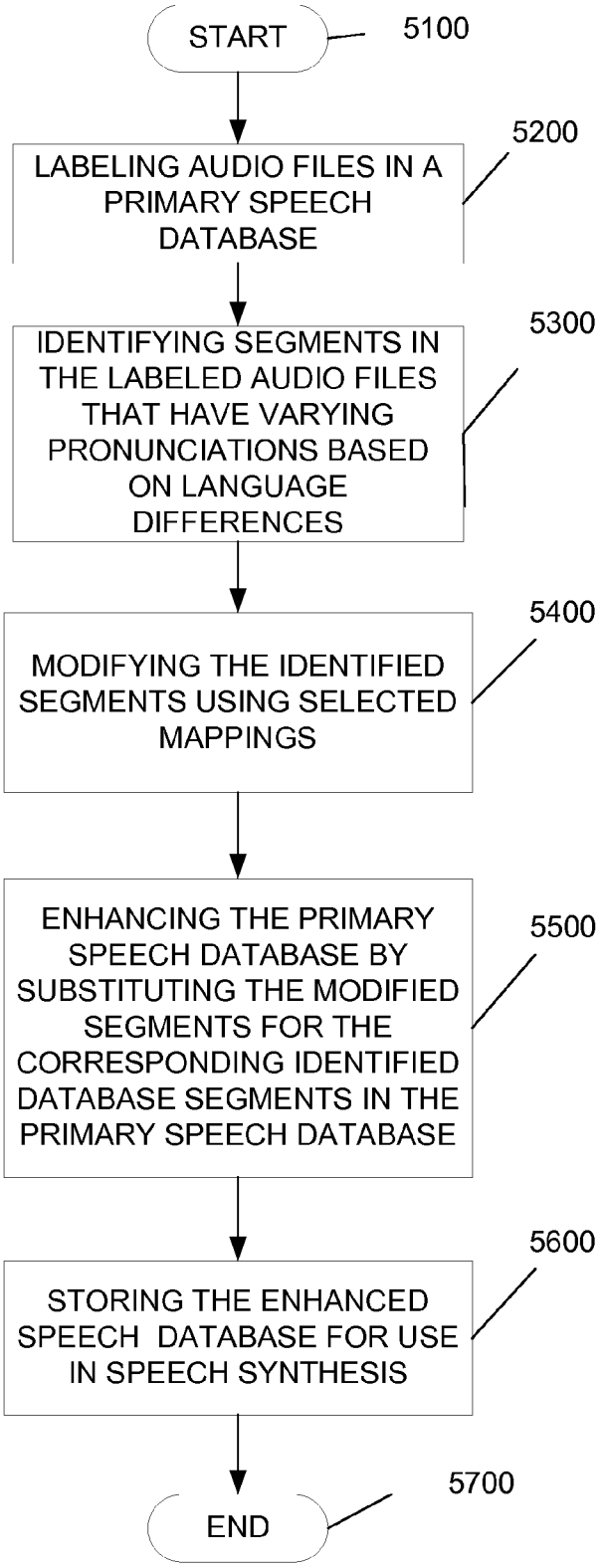
FIG. 5 illustrates an exemplary flowchart illustrating another possible speech database enhancement method in accordance with another possible embodiment of the invention.

FIG. 5 is an exemplary flowchart illustrating some of the basic steps associated with a speech database enhancement process in accordance with another possible embodiment of the invention. The process begins at step 5100 and continues to step 5200 where the speech database enhancement module 130 labels audio files in the primary speech database 120. At step 5300, the speech database enhancement module 130 identifies segments in the labeled audio files that have varying pronunciations based on language differences as discussed above.

At step 5400, the speech database enhancement module 130 modifies the identified segments in the primary speech database 120 using selected mappings. At step 5500, the speech database enhancement module 130 enhances the primary speech database 120 by substituting the modified segments for the corresponding identified database segments in the primary speech database 120. At step 5600, the speech database enhancement module 130 stores the enhanced primary speech database 120 for use in speech synthesis. The process goes to step 5700 and ends.

As an illustrative example of the FIG. 5 process, the speech database enhancement module 130 may use a speech representation model rather than the audio waveforms themselves, such as a harmonic plus noise model (HNM). In this process, the speech database enhancement module 130 may first convert the entire primary speech database 120 to HNM parameters. For each frame there is a noise component represented by a set of autoregression coefficients and a set of amplitudes and phases to represent the harmonic component. The speech database enhancement module 130 then modifies the HNM parameters. For example, the speech database enhancement module 130 may modify only the autoregression coefficients when a frame fell time-wise into one of the segments marked for change. In these cases, the modified autoregression coefficients were directly substituted for the originals in the primary speech database 120. The speech database enhancement module 130 may then store the modified set of HNM parameters along with the associated phone labels in the primary speech database 120 for use in unit selection speech synthesis. Alternatively, the primary speech database 120 may be converted to HNM parameters, be modified as described above, and then converted back to a different (or third) speech database.

Figure 6:
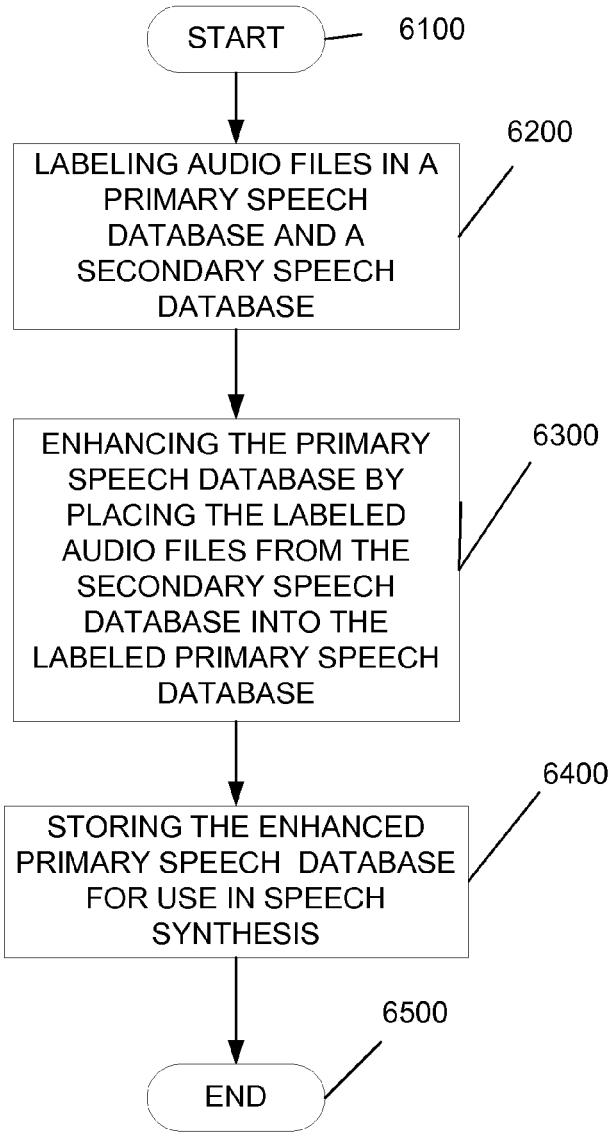
FIG. 6 illustrates an exemplary flowchart illustrating another possible speech database enhancement method in accordance with another possible embodiment of the invention.

FIG. 6 is an exemplary flowchart illustrating some of the basic steps associated with a speech database enhancement process in accordance with another possible embodiment of the invention. This process involves the speech database enhancement module 130 combining the primary speech database and the secondary speech database 140 to get the benefits of both databases for speech synthesis.

The process begins at step 6100 and continues to step 6200 where the speech database enhancement module 130 labels audio files in the primary speech database 120 and secondary speech database 140. At step 6300, the speech database enhancement module 130 enhances the primary speech database 120 by placing the audio files from the secondary speech database 140 into the primary speech database 120. At step 6400, the speech database enhancement module 130 stores the enhanced primary speech database 120 for use in speech synthesis. The process goes to step 6500 and ends.

In this process, all the database audio files and associated label files for the two different voices may be combined. The speech database enhancement module 130 may choose to label the speech segments so that there will be no overlap of speech segments (phonetic symbols). Naturally, segments marked as silence may be excluded from this overlap-elimination process due to the fact that silence in one language sounds much like silence in another. Using these audio files and associated labels a single hybrid voice was built.

The speech database enhancement module 130 may label the primary speech database 120 with a labeling scheme distinct from the secondary speech database 140. This process may provide for easier identification by the unit selector 220.

Alternatively, the speech database enhancement module 130 may label the primary speech database 120 with the same labeling scheme as the secondary speech database 140. In that instance, the duplicate segments may be discarded or be allowed to remain in the primary speech database 130.

As a result of the FIG. 6 process, access to the voice can be controlled at the phoneme level, with the choice of phones determining whether one voice will be heard in English, or the other voice in Spanish. The speech database enhancement module 130 may substitute phones simply by specifying a different phone symbol for particular cases. For example, the speech database enhancement module 130 may specify a /T/ unit rather than a /s/ unit in appropriate instances. Note that in this case the speech database enhancement module 130 makes no attempt to refine whatever phoneme boundaries were defined in the original primary speech database 120 itself. Often these boundary alignments can be less accurate than desired for the purposes of unit substitution.

Embodiments within the scope of the present invention may also include computer-readable media for carrying or having computer-executable instructions or data structures stored thereon. Such computer-readable media can be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium which can be used to carry or store desired program code means in the form of computer-executable instructions or data structures. When information is transferred or provided over a network or another communications connection (either hardwired, wireless, or combination thereof) to a computer, the computer properly views the connection as a computer-readable medium. Thus, any such connection is properly termed a computer-readable medium. Combinations of the above should also be included within the scope of the computer-readable media.

Computer-executable instructions include, for example, instructions and data which cause a general purpose computer, special purpose computer, or special purpose processing device to perform a certain function or group of functions. Computer-executable instructions also include program modules that are executed by computers in stand-alone or network environments. Generally, program modules include routines, programs, objects, components, and data structures, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Although the above description may contain specific details, they should not be construed as limiting the claims in any way. Other configurations of the described embodiments of the invention are part of the scope of this invention. For example, the principles of the invention may be applied to each individual user where each user may individually deploy such a system. This enables each user to utilize the benefits of the invention even if some or all of the conferences the user is attending do not provide the functionality described herein. In other words, there may be multiple instances of the speech database enhancement module 130 in FIGS. 1-3 each processing the content in various possible ways. It does not necessarily need to be one system used by all end users. Accordingly, the appended claims and their legal equivalents should only define the invention, rather than any specific examples given.

We claim:

1. A method comprising:

receiving, on a device having a processor, text from a user for conversion to speech via a text-to-speech process;

identifying, via the processor, a primary speech segment in a primary speech database which does not meet a need of the text-to-speech process;

identifying, via the processor, a replacement speech segment which satisfies the need in a secondary speech database; and adding replacement speech segment to the primary database such that the primary database meets the need of the text-to-speech process.

2. The method of claim 1, further comprising generating, via the processor, speech using the replacement speech segment from the primary speech database.

3. The method of claim 1, wherein the primary speech database has been further modified by identifying boundaries of the primary speech segment.

4. The method of claim 3, wherein phone boundaries of the primary speech segment are identified using a zero-crossing calculation.

5. The method of claim 1, wherein the need is based on one of dialect differences, geographic language differences, regional language differences, accent differences, national language differences, idiosyncratic speech differences, and database coverage differences.

6. The method of claim 1, wherein the primary speech segment comprises one of diphones, triphones, and phonemes.

7. The method of claim 1, wherein the primary speech database comprises first voice recordings in a first dialect, and the secondary speech database comprises second voice recordings in a second dialect, wherein the first dialect and the second dialect differ by one of dialect differences, geographic language differences, regional language differences, accent differences, national language differences, idiosyncratic speech differences, and database coverage differences.

8. The method of claim 1, wherein the primary speech segment is identified based on one of obstruents and nasals.

9. A system comprising:

a processor; and a computer-readable storage medium having instructions stored which, when executed by the processor, result in the processor performing operations comprising:

receiving, on the system, text from a user for conversion to speech via a text-to-speech process;

identifying a primary speech segment in a primary speech database which does not meet a need of the text-to-speech process;

identifying a replacement speech segment which satisfies the need in a secondary speech database; and adding replacement speech segment to the primary database such that the primary database meets the need of the text-to-speech process.

10. The system of claim 9, the computer-readable storage medium having additional instructions stored which, when executed by the processor, result in operations comprising generating speech using the replacement speech segment from the primary speech database.

11. The system of claim 9, wherein the primary speech database has been further modified by identifying boundaries of the primary speech segment.

12. The system of claim 11, wherein phone boundaries of the primary speech segment are identified using a zero-crossing calculation.

13. The system of claim 9, wherein the need is based on one of dialect differences, geographic language differences, regional language differences, accent differences, national language differences, idiosyncratic speech differences, and database coverage differences.

14. The system of claim 9, wherein the primary speech segment comprises one of diphones, triphones, and phonemes.

15. The system of claim 9, wherein the primary speech database comprises first voice recordings in a first dialect, and the secondary speech database comprises second voice recordings in a second dialect, wherein the first dialect and the second dialect differ by one of dialect differences, geographic language differences, regional language differences, accent differences, national language differences, idiosyncratic speech differences, and database coverage differences.

16. The system of claim 9, wherein the primary speech segment is identified based on one of obstruents and nasals.

17. A computer-readable storage device having instructions stored which, when executed by the computing device, result in the computing device performing operations comprising:

receiving, on the computing device, text from a user for conversion to speech via a text-to-speech process;

identifying a primary speech segment in a primary speech database which does not meet a need of a text-to-speech process;

identifying a replacement speech segment which satisfies the need in a secondary speech database; and adding replacement speech segment to the primary database such that the primary database meets the need of the text-to-speech process.

18. The computer-readable storage device of claim 17, having additional instructions stored which, when executed by the computing device, result in operations comprising generating, via the computing device, speech using the replacement speech segment from the primary speech database.

19. The computer-readable storage device of claim 17, wherein the primary speech database has been further modified by identifying boundaries of the primary speech segment.

20. The computer-readable storage device of claim 19, wherein phone boundaries of the primary speech segment are identified using a zero-crossing calculation.

* * * * *